US012723846B1

(12) United States Patent
Schott

(10) Patent No.: US 12,723,846 B1
(45) Date of Patent: Sep. 1, 2026

(54) ACCESSORY MOUNTING ATTACHMENT FOR RIFLE

(71) Applicant: Claus Schott, Oberlenningen (DE)

(72) Inventor: Claus Schott, Oberlenningen (DE)

( * ) Notice: Subject to any disclaimer, the term of this patent is extended or adjusted under 35 U.S.C. 154(b) by 0 days.

(21) Appl. No.: 19/241,328

(22) Filed: Jun. 17, 2025

(51) Int. Cl.
*F41G 11/00* (2006.01)
*F41A 35/02* (2006.01)
*F41G 1/16* (2006.01)

(52) U.S. Cl.
CPC ..... *F41G 11/007* (2013.01); *F41A 35/02* (2013.01); *F41G 1/16* (2013.01); *F41G 11/003* (2013.01)

(58) Field of Classification Search
CPC ..... F41G 11/007; F41G 1/16; F41G 11/003; F41A 35/02
USPC ..... 42/90
See application file for complete search history.

(56) References Cited

U.S. PATENT DOCUMENTS

| | | | | |
|---|---|---|---|---|
| D680,186 | S | 4/2013 | Fesas | |
| 8,407,925 | B2 * | 4/2013 | Fesas | F41A 3/66 42/75.01 |
| D791,899 | S | 7/2017 | Fesas | |
| 10,598,464 | B2 * | 3/2020 | Faifer | F41G 11/004 |
| 12,540,789 | B2 * | 2/2026 | Storch | F41A 35/02 |
| 2018/0340756 | A1 * | 11/2018 | Faifer | F41G 11/003 |

OTHER PUBLICATIONS

PRAGMA-Teck Jagd-Schalldampfer, "Assembly Instructions for the Dustcover Model: Dustcover 04-003-00," CFS CNC-Technik GmbH, Hoher Stich 4, D-73252 Lenningen, Germany, Jan. 2022.
F.A.B. Defense, "AKM Picatinny Scope-Mount Dust Cover," https://fab-defenseus.com/pdc-ak-ak-akm-picatinny-scope-mount-dust-cover/, Prior to Jun. 5, 2025.
Mounting Solutions Plus, Internet Advertisement for Rifle Mounts, "AK-47 Mounts," https://www.mountsplus.com/AK-47-mounts.html, Prior to Jun. 5, 2025.

* cited by examiner

*Primary Examiner* — Samir Abdosh
(74) *Attorney, Agent, or Firm* — Muncy, Geissler, Olds & Lowe, P.C.

(57) ABSTRACT

An accessory mounting attachment for repeatable precise alignment on a rifle has a mounting section with a top rail. The mounting section has a forward portion with a rear sight leg configured for a pivotable mounting to a rear sight base on the rifle, and a rearward portion with a lock down assembly configured to fix the mounting section to a connecting lug at a rear of a receiver of the rifle. The lock down assembly includes an eccentric element, a lug latching frame, and a coupling element connecting the two. Rotation of the eccentric element by a lever section causes the lug latching frame to move vertically and engage/latch with the connecting lug, so that the accessory mounting attachment is consistently and securely fixed in a same position relative to a barrel of the rifle, which keeps a sighting device attached to the top rail zeroed to the rifle.

20 Claims, 8 Drawing Sheets

ACCESSORY MOUNTING ATTACHMENT FOR RIFLE

The present invention generally relates to an accessory mounting attachment for repeatable precise alignment on a rifle, as well as a rifle with the accessory mounting attachment. More particularly, the present invention relates to an easy to operate lock down assembly, which couples and decouples the accessory mounting attachment above the rifle's receiver in a consistent position to maintain zeroed-in aiming of any scope, laser, rear sight or other accessory attached to the accessory mounting attachment.

BACKGROUND OF THE INVENTION

Accessory mounting attachments for rifles are generally known. Accessories enable the functionality of the rifle to be expanded. For example, the accessory mounting attachment can include one or more picatinny rails. Using the picatinny rail, the rifle can be equipped with sighting devices like a red-dot sight or telescopic scope, night vision devices, laser attachments, flashlights, infrared illuminators and other function-enhancing devices. Such function-enhancing devices are particularly advantageous for assault rifles and machine guns and can further expand the operational capabilities of the rifle.

There are rifles with factory-installed, integrated accessory mounts, such as the picatinny rail. These are often modern variants of rifles. However, older types of rifles are still widely used today. An example of this is the rifle know as the Automat Kalashnikov (AK). This refers to a series of rifles technically based on the original model AK-47. Variants include the AKM, AK-74, AK-74M, AK-100 series and AK-12. While modern AK-12 rifles are equipped with standard accessory mounts, such as short rails, on the receiver and/or a barrel shroud, this is not the case with older AK variants. Older AK variants have an open mechanical sighting system with a rear sight and a front sight system. The rear sight is pivotably mounted near a front of the receiver housing. Up and down pivoting of the rear sight allows for the adjustment of the desired range. The attachment of sighting devices, such as a telescopic scope, red-dot sight, laser or similar accessories was not originally intended for these older AK variants.

After-market, operator-installed accessory rails are known in the prior art and have been used to add a sighting device to such AK variant rifles to improve the accuracy and operational capabilities. Such operator-installed accessory rails mount to the AK variant rifles in various ways. One prior art accessory mounting attachment is configured as multi-part shells that partially or fully enclose the receiver. However, the installation of this accessory mounting attachment is complex, since the accessory mounting attachments are typically fixed to the housing using multiple bolts or screws. If original treaded bores in or behind the walls of the receiver are used in the installation, removing the original bolts and passing the original bolts (or longer after-market bolts) through the accessory mounting attachment anchors and back into the original threaded bores of the receiver wall can be difficult. When the original bolts are released from the receiver walls this can cause the release and shifting of parts relating to the receiver and complicate the reassembly due to alignment of the parts when the consumer tries to reinstall the bolts back into the original threaded bore holes.

Another prior art accessory mounting attachment avoids using the original bolts by using new screws which tap into newly bored holes in the receiver walls. Many rifle owners dislike this type of mounting method for an accessory mounting attachment because the original receiver is modified by the addition of bore holes. Hence, the rifle cannot be brought back to its original condition after the accessory mounting attachment is removed from the rifle.

Whenever bolts or screws are used to mount the accessory mounting attachment to the rifle, the inner diameters of through holes in the anchors of the accessory mounting attachment will be slightly larger in diameter as compared to the outer diameters of the original bolts or new bolts or new screws. Before the bolts or screws are tightened, there will be some "play" in the interface between the accessory mounting attachment and the receiver. In other words, it would be possible to slide the accessory mounting attachment slightly in the forward-rearward direction and up-down direction before the bolts or screws are tightened down. Some accessory mounting attachments may even use through slots instead of through holes, so that the accessory mounting attachment can be slid more forward or rearward during mounting at the consumer's discretion to move a top mounted rail closer or further from the rear of the receiver and/or to accommodate the common occurrence that precise bolt hole placement and spacing on the receiver of the AK variant rifle may slightly differ from rifle to rifle due to different manufacturers of the rifle.

When a prior art accessory mounting attachment discussed above is added to a rifle, the customer will attach a sighting device, e.g., a telescopic scope, to a top rail of the accessory mounting attachment. Then, the customer will sight-in the scope so that the cross hairs within the scope are aligned to the impact of the rifle's fired rounds from the barrel at a set distance/elevation. After sighting-in the scope, i.e. zeroing the scope, the performance of the prior art accessory mounting attachment is good. However, rifles periodically need service and internal cleaning within the receiver, e.g., fixing, cleaning or replacing a recoil spring within the receiver of the AK-style rifle.

With an AK-style rifle, this entails removal of the upper dust cover over the receiver, which lifts upwardly and off of the receiver. Since the prior art accessory mounting attachments discussed above are typically attached to the receiver side wall or walls and a factory-formed bent section resides over the top of the dust cover placing the top rail above the dust cover, it is not possible to remove the dust cover without removing the prior art accessory mounting attachment. After the rifle is fixed or cleaned internally, e.g., replacing or cleaning a recoil spring, the dust cover is reattached, and the accessory mounting attachment is remounted to the receiver. Due to the "play" in the installation of the accessory mounting attachment, it is not precisely in the same alignment relative to the barrel of the rifle. Therefore, it frequently occurs that the scope must be sighted-in again. This can be a time-consuming annoyance to a customer, who needs to spend the money and time to fire a few more rounds of ammunition and check a target downrange at some distance, e.g., 200 meters, to see if the scope is sighted-in again. This procedure is not acceptable in a combat situation, where the rifle needs to maintain its zeroed-in sighting after a quick field repair under the dust cover during combat.

Another prior art accessory mounting attachment is configured as a top rail mounted to a reinforced dust cover. In simple form, the original dust cover is removed from the rifle and stored away. The reinforced dust cover with an integral top rail is then attached to the rifle using the same rifle mounting features which held the original dust cover. This entails a press fitting of a forward edge of the reinforced dust cover under a hood on the rifle, and snapping a cutout box-shaped opening in the rear of the reinforced dust cover over a spring-load connecting lug at the rear of the receiver. The operation is shown at: https://www.youtube.com/shorts/MDBnAjSljy0, and it is interesting to note how the video presenter mentions that the attachment is not consistent. Such an accessory mounting attachment would typically loose zero after the reinforced dust cover is removed and reinstalled on the rifle, and may also loose zero as the rifle is fired, since the cutout box-shaped opening is larger than the spring-loaded connecting lug captured therein, i.e., there is quite a bit of "play" or open space around lug within the cutout box-shaped opening. The vibration of the rifle firing and reloading a new round can cause the cutout box-shaped opening of the dust cover to shift positions relative to the connecting lug.

One attempt to improve on the security of the mounting between the reinforced dust cover would be to attach the rear of the reinforced dust cover to the top of the receiver with a screw or bolt and not rely on the spring-loaded connecting lug within the cutout opening. However, this means that the screw must be removed to open the reinforced dust cover and service the rifle inside of the receiver. Hence, the same issues involving screws and bolts discussed above would apply to this prior art accessory mounting attachment. Also, a tool, e.g., a screw driver, is need to remove the dust cover.

Finally, another prior art method for attaching the rear of the reinforced dust cover to the rear of the receiver involves tightening down a tensioning mechanism in the form of a knurled wheel located above the dust cover connecting lug. The knurled wheel causes a projection to move vertically and bear against a feature of the rifle, e.g., the connecting lug, which moves the dust cover relative to the connecting lug and removes some of the potential "play" between the connecting lug and dust cover. This would reduce rattling and assist in holding a zeroed-in scope. A disadvantage of this known accessory mounting attachment is that it cannot be quickly opened from the locked position. The knurled wheel must be manually turned with several partial turns, is somewhat difficult to access and hard to turn. Often times, gloves and/or a rag are needed to get a better grip on the knurled wheel and the operator needs strong finger strength to fully tighten and to release the knurled wheel. In the following video around the timeframe 7:27 to 8:10, the presenter mentions that the knurled wheel can be very tight and he is unable to use his bare fingers to turn the knurled wheel. The presenter is delayed in opening the dust cover, and eventually uses folded-up rubber gloves to gain enough grip strength and frictional pressure to rotate the knurled wheel and remove the reinforced dust cover with an integral top rail off of the rifle to gain access into the receiver within the AK-style rifle. The video can be found at: https://www.youtube.com/watch?v=pdSUhwzYExw.

SUMMARY OF THE INVENTION

It is an object of the present invention to provide an improved accessory mounting attachment for repeatable precise alignment on a rifle, which overcomes one or more of the aforementioned mentioned disadvantages of the prior art. Furthermore, it is an object of the present invention to provide not just an aftermarket accessory for a rifle, but an actual rifle with the accessory mounting attachment, according to the invention, mounted thereto from the factory.

It is an object of the present invention to provide an accessory mounting attachment for a rifle, which is securely attached to the rifle without play, slack or looseness in its mounting arrangement to the rifle.

It is an object of the present invention to provide an accessory mounting attachment for a rifle, which can be quickly and easily removed from the rifle without the need of tools.

It is an object of the present invention to provide an accessory mounting attachment for a rifle, which includes a lever section which can be easily actuated by an operator's fingers, whether bare-skinned or wearing gloves, with less force and difficulty to lock and unlock the accessory mounting attachment, as compared to a knurled wheel.

The lever section may be actuated between a closed position, which secures the accessory mounting attachment to the rifle and an open position, which allows the accessory mounting attachment to be pivoted away from, or removed from, the rifle.

It is an object of the present invention to provide an accessory mounting attachment for a rifle, which allows access to the interior of a receiver of an AK-style rifle for cleaning and maintenance, while the accessory mounting attachment is pivoted upward via a pivotable mounting to a rear sight base.

It is an object of the present invention to provide an accessory mounting attachment for a rifle, which after being pivoted away from the rifle or removed from the rifle can be re-mounted to the rifle while maintaining zeroing of any sighting device mounted to the accessory mounting attachment relative to a barrel of the rifle.

One, several or all of these objects are accomplished by an accessory mounting attachment for repeatable precise alignment on a rifle having a mounting section with a top rail. The mounting section has a forward portion with a rear sight leg configured for a pivotable mounting to a rear sight base on the rifle, and a rearward portion with a lock down assembly configured to fix the mounting section to a connecting lug at a rear of a receiver of the rifle. The lock down assembly includes an eccentric element, a lug latching frame, and a coupling element connecting the two. Rotation of the eccentric element by a lever section causes the lug latching frame to move vertically and engage/latch with the connecting lug, so that the accessory mounting attachment is consistently and securely fixed in a same position relative to a barrel of the rifle, which keeps a sighting device attached to the top rail zeroed to the rifle.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitive of the present invention, and wherein.

DETAILED DESCRIPTION

Figure 1:
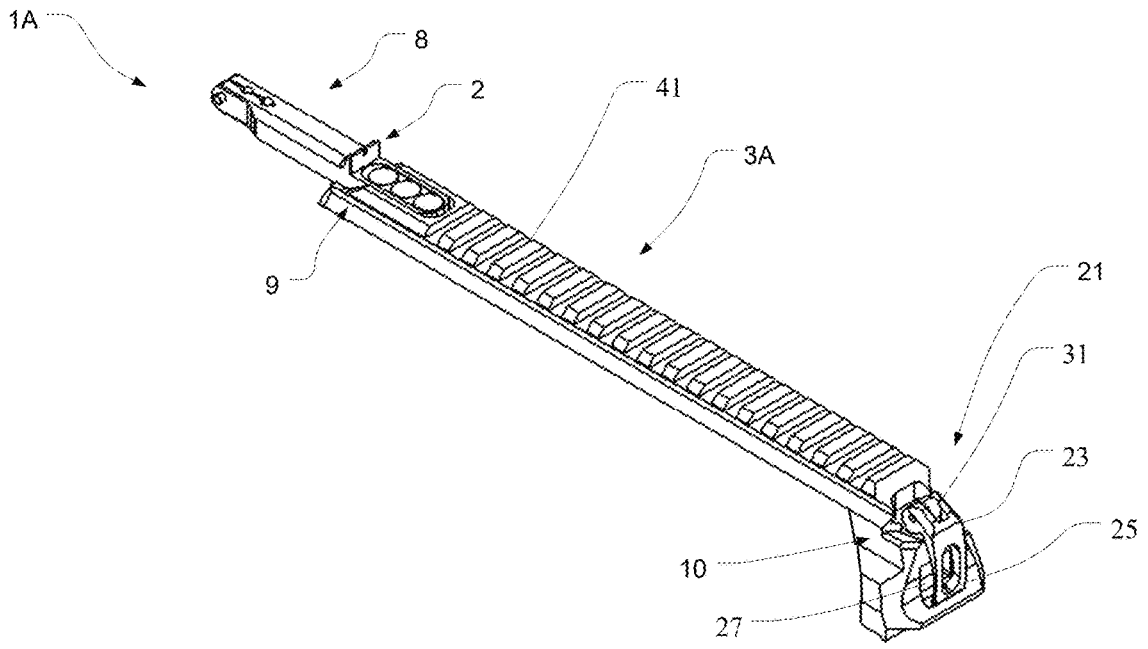
FIG. 1 is a perspective view of an accessory mounting attachment according to a first embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

FIG. 1 shows a perspective view of an accessory mounting attachment 1A according to a first embodiment of the invention. The accessory mounting attachment 1A comprises a mounting section 3A, a rear sight leg 8, and a lock down assembly 21. The mounting section 3A is elongated and has a forward portion 9 and a rearward portion 10. A mounting rail 41 is formed along a top side of the mounting section 3A. The mounting rail 41 is configured as a toothed rail, such as a picatinny rail.

The rear sight leg 8 is connected to the forward portion 9 of the mounting section 3A. In one embodiment, the connection is made by two or three threaded fasteners and may be adjustable in the horizontal direction via horizontal slots as through holes in the rear sight leg 8. In an alternative embodiment, the rear sight leg 8 may be integrally formed with the mounting section 3A and not be horizontally adjustable relative thereto. The rear sight leg 8 extends forward of the forward portion 9 of the mounting section 3 and includes a rear notch-style sight 2.

The lock down assembly 21 is connected to the rearward portion 10 of the mounting section 3A, as will be explained hereinafter. The lock down assembly 21 comprises an eccentric element 23, a lug latching frame 27, and a coupling element 31. The eccentric element 23 is movably connected to the coupling element 31. A lever section 25 is attached to the eccentric element 23. More preferably, the eccentric element 23 and the lever section 25 are formed as a single piece. The eccentric element 23 with the lever section 25 is arranged to function rearwardly of the rearward potion 10 of the mounting section 3A, opposite the forward portion 9 of the mounting section 3A. The lever section 25 may rest against, or seat into a recess of, an outer surface of a rear side of the mounting section 3A, as shown in FIG. 1, and may pivot upward and protrude away from the outer surface of the rear side of the mounting section 3A to be exposed, as further described below.

Figure 2:
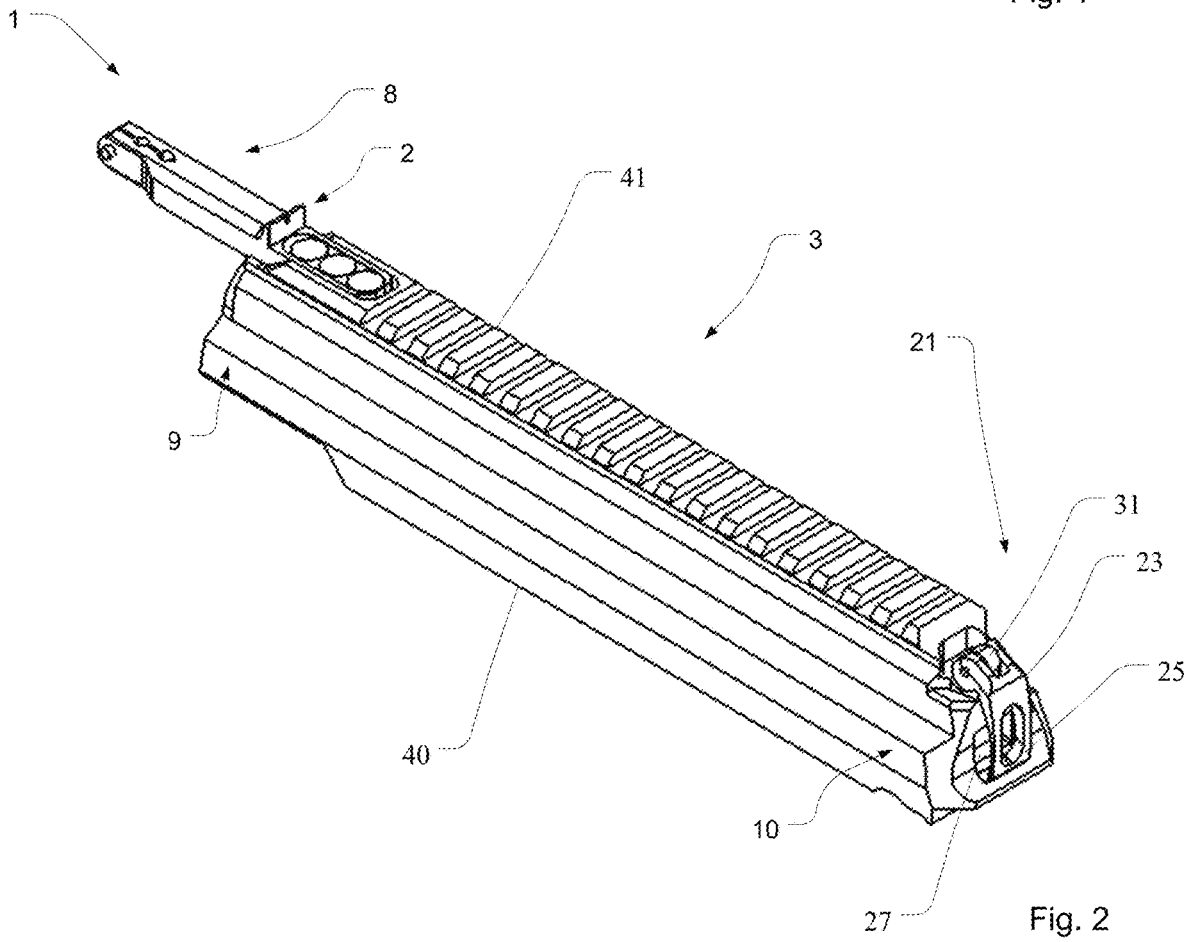
FIG. 2 is a perspective view of an accessory mounting attachment according to a second embodiment of the invention.

FIG. 2 shows a perspective view of an accessory mounting attachment 1 according to a second embodiment of the invention. In contrast to FIG. 1, in FIG. 2 a mounting section 3 includes a dust cover 40. The dust cover 40 is semi-shell shaped. The dust cover may be one or more panels connected to a mounting section like mounting section 3A in FIG. 1 by threaded fasteners or welding. However, in a preferred embodiment, the dust cover 40 is integrally formed with the mounting section 3. The rear sight leg 8 and the lock down assembly 21 of FIG. 2 are configured in the same way as described in connection with FIG. 1.

Figure 3:
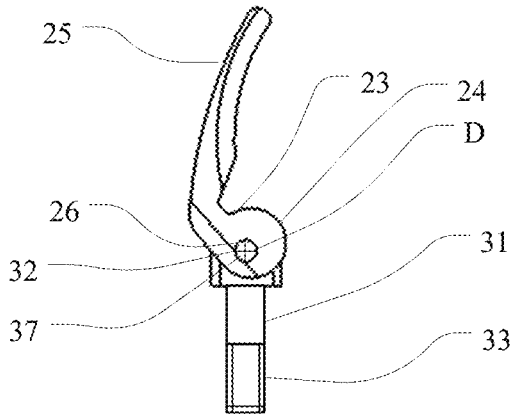
FIG. 3 is a side view of an eccentric element with a coupling element.

FIG. 3 shows a side view of the eccentric element 23 with a coupling element 31. The eccentric element 23 comprises the lever section 25, an axle opening 26, and a cam disk 24. The cam disk 24 is circular in shape and formed as an outer perimeter of the eccentric element 23. The axle opening 26 is positioned eccentrically, e.g. off-centered, relative to the circular cam disk 24.

Figure 8A:
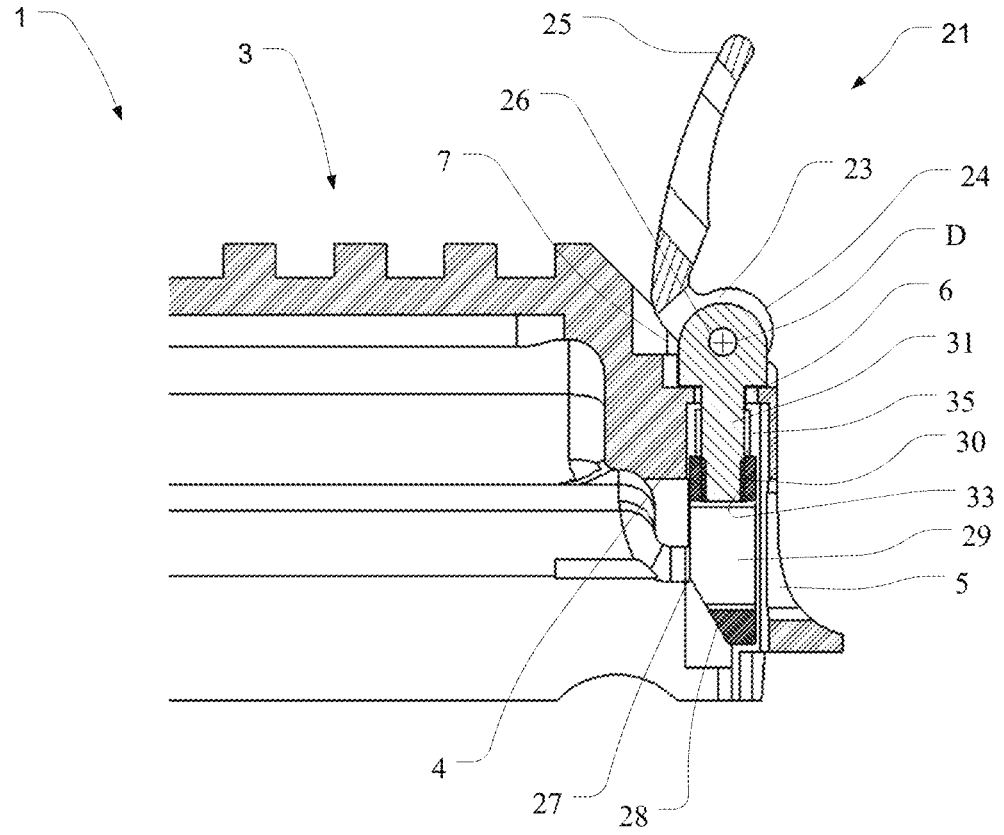
FIG. 8A is a sectional view taken through a center axis of the coupling element and along a longitudinal extension direction of the accessory mounting attachment, with the lock down assembly open.
Figure 8B:
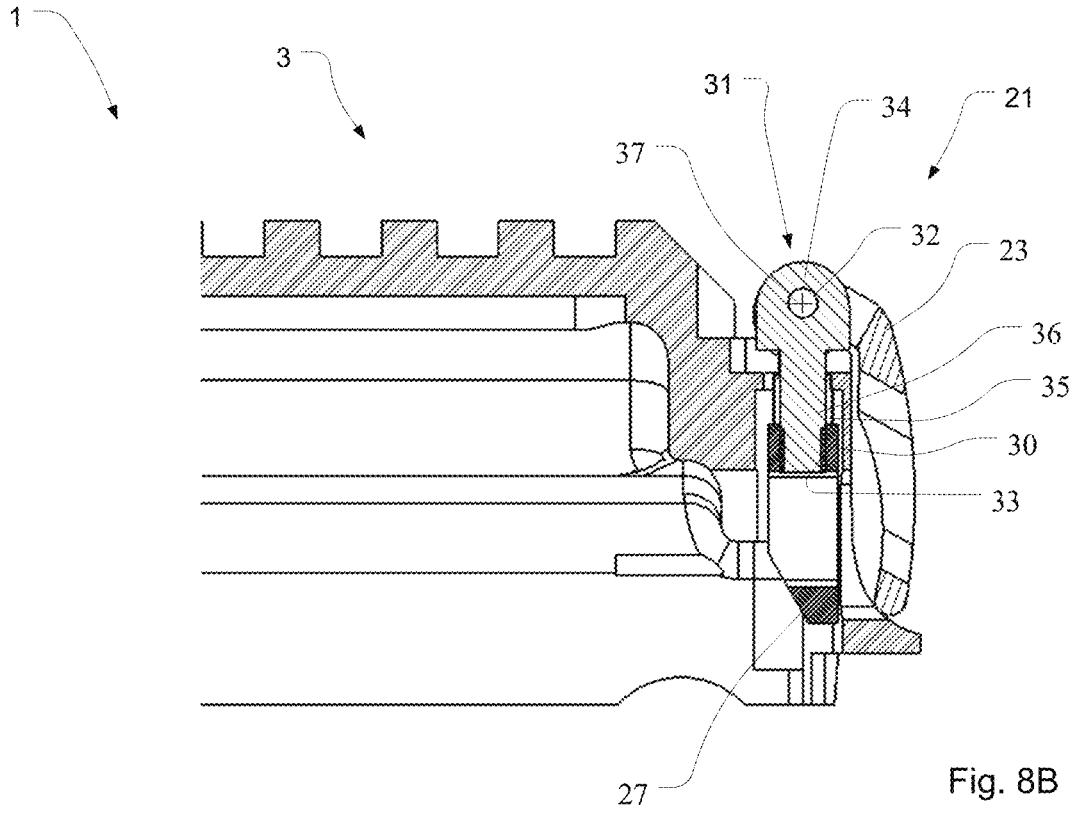
FIG. 8B is the same view as FIG. 8A, but with the lock down assembly closed.

As best seen in FIG. 8B, the coupling element 31 comprises an interface section 34 in an upper portion thereof. An axle mount 32 is formed in the interface section 34. A lower portion 36 of the coupling element 31 is cylindrically shaped. An adjuster 33 is formed in the lower portion 36. The adjuster 33 is configured as an external or an internal fine thread.

Figure 5:
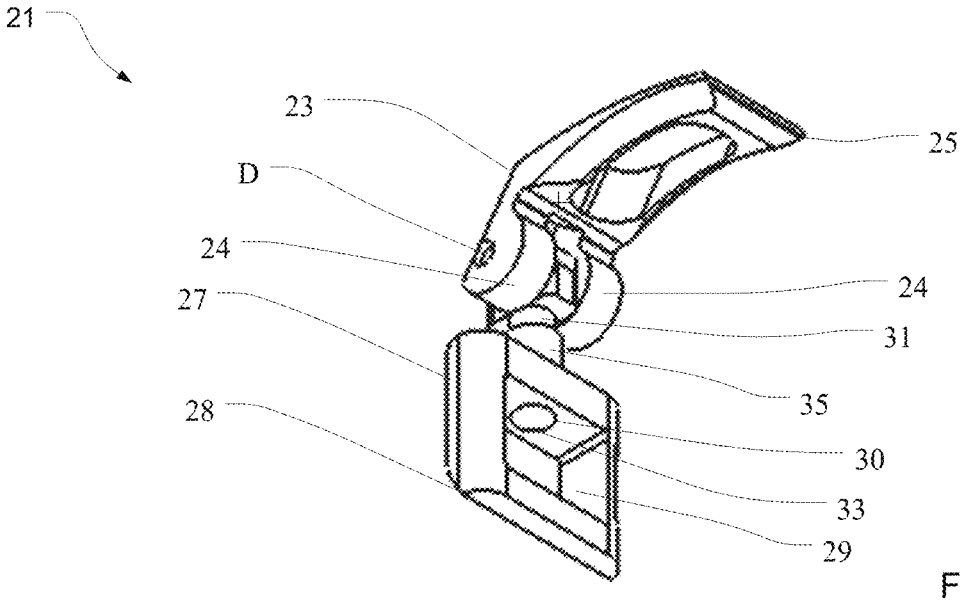
FIG. 5 is a bottom perspective view of a lock down assembly formed by the eccentric element, the coupling element and the lug latching frame.
Figure 9A:
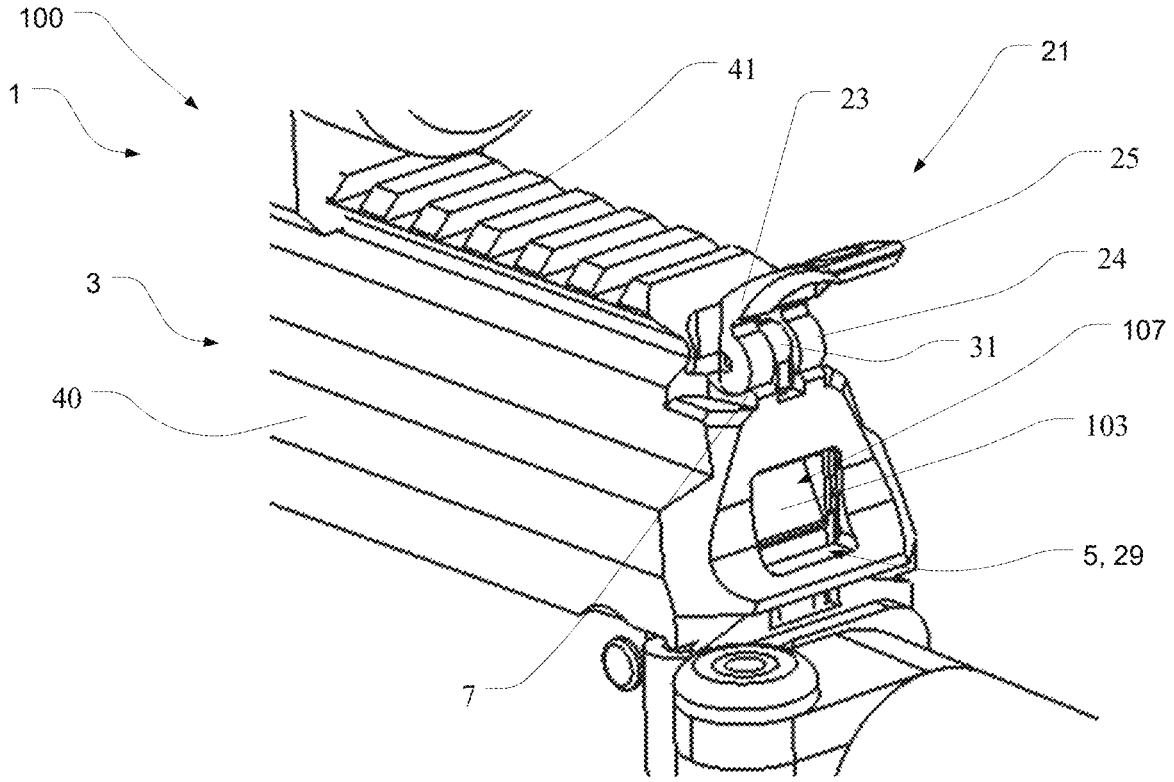
FIG. 9A is a partial perspective view of the accessory mounting attachment on a rifle with the lock down assembly open.

The eccentric element 23 and the coupling element 31 are connected in a hinge-like manner via an axle 37. The cam disk 24 surrounds the interface section 34 of the coupling element 31 on two sides. In other words, the coupling element 31 sits between first and second sections of the cam disk 24, as best seen in FIGS. 5 and 9A. The axle 37 passes through the axle openings 26 of the eccentric element 23 and the axle mount 32 of the coupling element 31. The axle 37 forms a common pivot point D between the eccentric element 23 and the coupling element 31. The axle 37 may be configured as a pivot pin. The axle 37 may also be configured as a spring rod.

Figure 4:
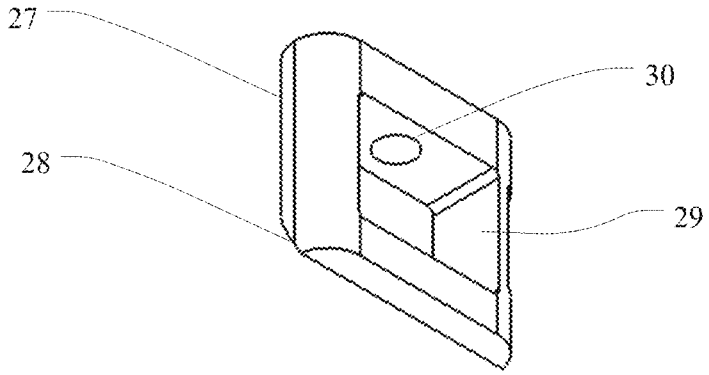
FIG. 4 is a perspective view of a lug latching frame.

FIG. 4 shows a perspective view of a lug latching frame 27. An open latching window 29 is formed through the lug latching frame 27. The latching window 29 is centrally aligned relative to the lug latching frame 27. A latching slope 28 is formed in a lower portion of the lug latching frame 27. The latching slope 28 is chamfer like. The latching slope 28 ascends obliquely from a base to a lower edge or frame of the latching window 29.

An adjustment interface 30 is formed in an upper portion of the lug latching frame 27. The adjustment interface 30 is configured as a hole with an internal or external fine thread to mate with the external or internal fine thread of the adjuster 33 of the coupling element 31. For pre-setting, the coupling element 31 may be rotated relative to the lug latching frame 27 via the eccentric element 23. Through the rotational movement, the coupling element 31 is screwed into or out of the lug latching frame 27.

FIG. 5 shows a bottom perspective view of the lock down assembly 21 with the eccentric element 23, the coupling element 31 and the lug latching frame 27 in an assembled state. The eccentric element 23, the coupling element 31, and the lug latching frame 27 correspond to the elements described in FIGS. 3 and 4.

The eccentric element 23 is connected to the lug latching frame 27 via the coupling element 31. The adjuster 33 of the coupling element 31, configured as an external or internal thread, is screwed into the adjustment interface 30 of the lug latching frame 27, configured as a mating, internal or external thread. This threaded connection permits adjustment of the vertical position of the lug latching frame 27 relative to the eccentric element 23, e.g., shortening or lengthening the distance, as needed. An elastic 35 is arranged between the eccentric element 23 and the lug latching frame 27. The elastic 35 is arranged around the cylindrical, lower portion 36 of the coupling element 31, and may be formed as a metal, resilent spring.

Figure 6:
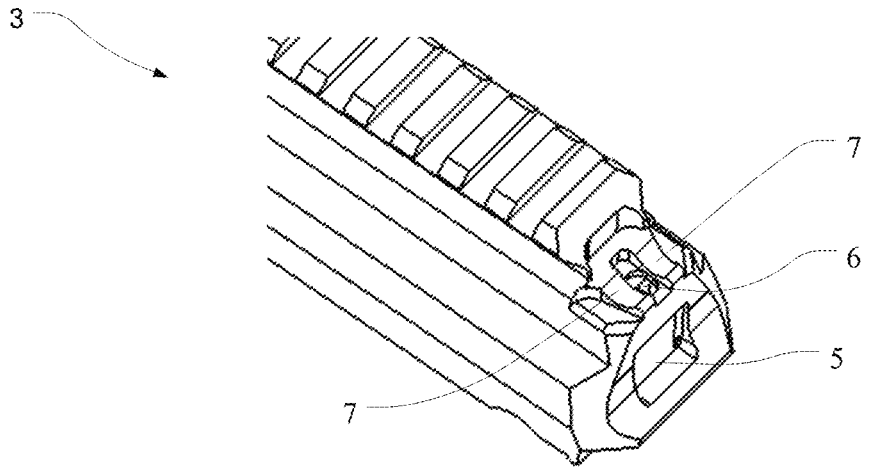
FIG. 6 is a perspective view of a rearward portion of the mounting section with the lock down assembly removed.

FIG. 6 shows a perspective view of the rearward portion 10 of the mounting section 3. A lug access opening 5 for accessing a connecting lug 103 (see FIG. 13) is formed on a rear side of the mounting section 3. A coupling element opening 6 for the lower portion 36 of the coupling element 31 (See FIG. 3) is formed on an upper side of the mounting section 3. The coupling element opening 6 for the lower portion 36 of the coupling element 31 is configured as a through hole. Additionally, two rolling tracks 7 are formed on the upper side of the mounting section 3. The rolling tracks 7 are semicircular in shape. The two rolling tracks 7 are arranged on a left side and a right side of the coupling element opening 6.

Figure 7A:
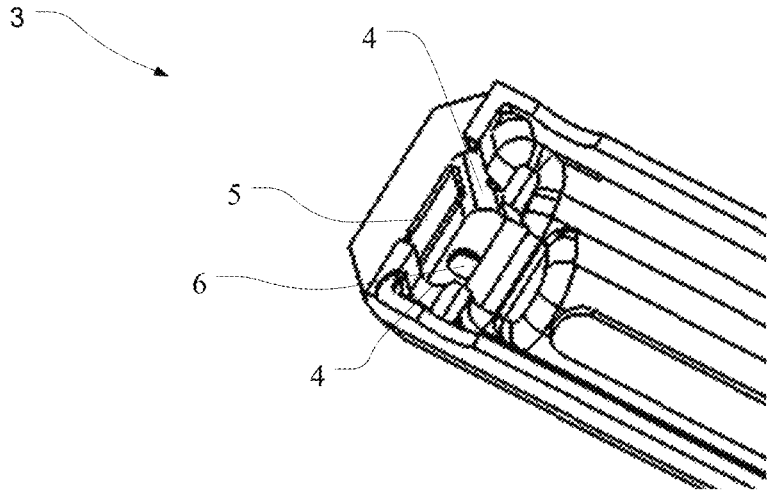
FIG. 7A is a perspective view of an inner side of the rearward portion of the mounting section with the lock down assembly removed.

FIG. 7A shows a perspective view of the inner side of the rearward portion 10 of the mounting section 3. Opposing guide recesses 4 are formed on the inner side. The guide recesses 4 have a rectangular base with semicircular ends. The guide recesses 4 extend vertically along the mounting section 3. The guide recesses 4 border the lug access opening 5 on the rear of the mounting section 3. The coupling element opening 6 is located on an upper side of the mounting section 3, approximately in the middle and between the opposed guide recesses 4, noting that the upper side is the bottom portion in FIG. 7A.

Figure 7B:
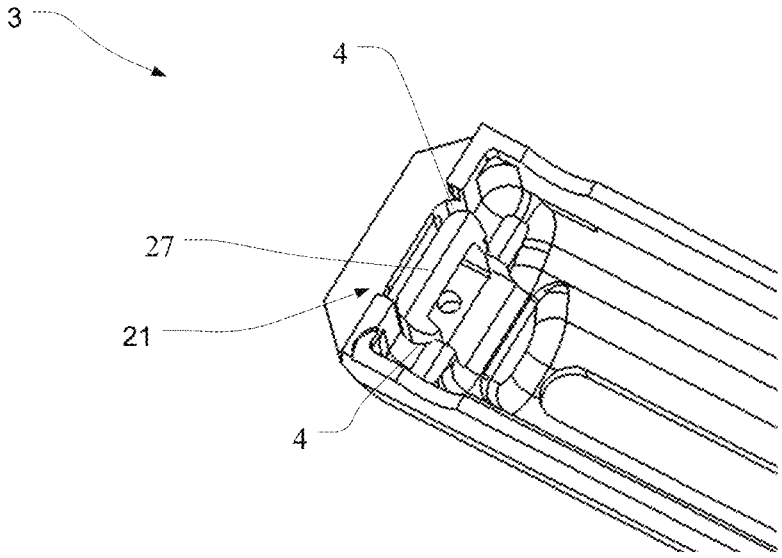
FIG. 7B is a perspective view of the inner side of the rearward portion of the mounting section with the locking down assembly installed.

FIG. 7B shows a perspective view of the inner side of the rearward portion 10 of the mounting section 3. The depiction of the mounting section 3 in FIG. 7B corresponds to the depiction of the mounting section 3 in FIG. 7A. In contrast to FIG. 7A, the lock down assembly 21 is installed in the rearward portion 10 of the mounting section 3 in FIG. 7B. The lug latching frame 27 is vertically displaceable and can slide against the opposed guide recesses 4. The outer geometry of the lug latching frame 27 is complementary to the guide recess 4. The lug latching frame 27 may be horizontally immovable within the guide recesses 4. This means that the lug latching frame 27 remains in a defined horizontal position during vertical displacement.

FIGS. 8A and 8B each show a sectional view taken through a center axis of the coupling element opening 6 and along the longitudinal extension direction of the accessory mounting attachment 1. The lock down assembly 21 described in FIG. 5 is arranged in the rearward portion 10 of the accessory mounting attachment 1. The eccentric element 23 is arranged on the upper side of the mounting section 3. The lug latching frame 27 is arranged on the inner side of the mounting section 3. The lug latching frame 27 is vertically displaceable in its mounting between the opposing guide recesses 4 on the inner side of the mounting section 3.

The coupling element 31 passes through the mounting section 3 through the coupling element opening 6. The elastic 35 is arranged in an area inside of the mounting section 3 and between the opposing guide recesses 4. The elastic 35 is positioned between the upper surface of the lug latching frame 27 and the eccentric elements 23. The elastic 35 may be preloaded between an upper section of the lug latching frame 27 and the inner side of the mounting section 3. The upper section of the lug latching frame 27 faces the eccentric element 23. The elastic 35 is configured such that the force it generates acts in the vertical direction of the lug latching frame 27. This force pushes the lock down assembly 21 toward a direction of the lug latching frame 27. The elastic 35 may, for example, be formed from a spring, a rubber, or another elastic component. In the case where the coupling element 31 is cylindrically shaped, the spring element may be a compression spring. The compression spring may be arranged around the cylindrical coupling element 31. The elastic 35 acts in a vertical direction and holds the lug latching frame 27 and the eccentric element 23 in the position set by the actuating movement of the eccentric element 23. The cam disks 24 on the eccentric elements 23 sit in the semicircular rolling tracks 7 on the mounting section 3 and may be under pressure to stay seated due to the force of the elastic 35.

In the position depicted in FIG. 8A, the latching window 29 and the lug access opening 5 on the rear of the mounting section 3 form an approximately aligned common opening. In FIG. 8A, the lug latching frame 27 is in a first position. In the first position, the lug latching frame 27 is in its lowest possible predefined vertical position, which is considered an open position. In the open position, the connecting lug 103 may be depressed against the force of the recoil spring to move it in the direction of the front of the rifle and outside of the latching window so that the rear of the dust cover 40 is free to move vertically upward and begin to pivot open to access the interior of the receiver of the rifle.

In FIG. 8B, the lug latching frame 27 is in a second position, consider a closed position. In the second position, the lug latching frame 27 is in its highest possible predefined vertical position. In the second position, the lug latching frame 27 is elevated. The transition of the lug latching frame 27 from the first position in FIG. 8A to the second position in FIG. 8B will now be described.

The eccentric element 23 is grasped via the lever section 25. The lever section 25 is pivoted downward by the user to cause an actuating movement of the eccentric element 23. The pivoting movement is limited by the lever section 25 resting against the outer surface of the accessory mounting attachment 1 in the area of the rear side of the mounting section 3. The eccentric element 23 rotates by the cam disks 24 (outer surfaces of the eccentric element) turning on the rolling tracks 7 of the mounting section 3. Comparing FIG. 8A to FIG. 8B, as the eccentric element turns, the common pivot point D elevates relative to the upper surface of the mounting section 3, causing the connecting element 31 to be vertically displaced upwardly. This causes the lug latching frame 27 to be vertically moved from the first position to the second position. The elastic 35 is also preloaded, e.g., as by compressing a spring or a resilient rubber cylinder, and holds the lug latching frame 27 in its second position when the lever section 25 comes to rest against the outer surface of the accessory mounting attachment 1.

Figure 9B:
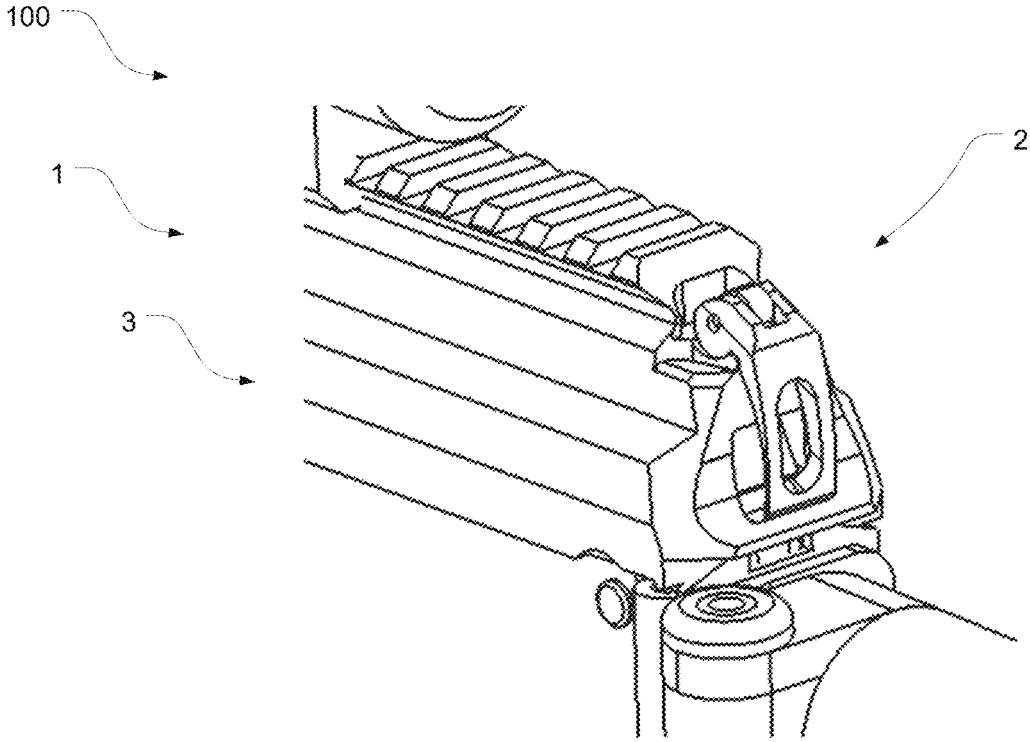
FIG. 9B is the same view as FIG. 9A, but with the lock down assembly closed.

FIG. 9A and FIG. 9B each show a perspective view of the accessory mounting attachment 1 on a rifle 100 according to the invention. The mounting section 3 has the dust cover 40 for the rifle 100. A connecting lug 103 is formed at a rear end section of the rifle 100. The connecting lug 103 is connected to a recoil spring arrangement 107 (See FIG. 13) within the rifle. The recoil spring arrangement 107 plays a role in the cycling of the rifle between shots. The recoil spring arrangement 107 also biases the connecting lug 103 in a rearward direction to hold down a standard dust cover on an AK-style rifle. Pressing the connecting lug 103 forward, against the spring pressure, releases the standard dust over from the top of the receiver of the AK-style rifle. In the present invention, the connecting lug 103 extends into the latching window 29. The connecting lug 103 remains accessible from the rear of the mounting section 3 through the latching window 29 and the lug access opening 5 in the rear of the mounting section 3.

In FIG. 9A, the lock down assembly 21 is in the same state as in FIG. 8A. In FIG. 9A, the rearward portion 10 of the mounting section 3 with the lock down assembly 21 is positioned above the connecting lug 103. The connecting lug 103 extends into the latching window 29 of the lug latching frame 27 and is loosely accommodated therein.

In FIG. 9B, the lock down assembly 21 is in the same state as in FIG. 8B. FIG. 9B shows the state after user has moved the lever section 25 into abutment or near abutment with the rear of the accessory mounting attachment 1. The lug latching frame 27 is in the second position, elevated in a predefined vertical position, so to engage in a latching manner with the connecting lug 103. The predefined vertical position is a position whereby a lower edge of the latching window 29 is engaging the lower face of the connecting lug 103 and is pulling upward on the connecting lug 103 to such an extent that the dust cover 40 seats to the top of the receiver of the rifle 100 and the lever section 25 comes into abutment or near abutment with the rear of the mounting section (FIG. 9B). If too much resistance is encountered and the lever section 25 cannot be locked down, a distance between the eccentric element 23 and the top of the latching window 29 can be made longer by rotating the adjuster 33 in the adjustment interface 30, i.e., rotating the threaded engagement between the coupling element 31 and the threaded bore 30 in the top wall of the lug latching frame 27. By this arrangement, the accessory mounting attachment 1 is fixed in a defined functional position relative to the barrel of the rifle 100. If the connecting lug is not latched, e.g., tightly secured, into the latching window 29, the distance between the eccentric element 23 and the top of the latching window 29 can be made shorter by rotating the adjuster 33 in the adjustment interface 30 in an opposite direction, i.e., rotating the threaded engagement between the coupling element 31 and the threaded bore 30 in the top wall of the lug latching frame 27 in an opposite direction.

Figure 10:
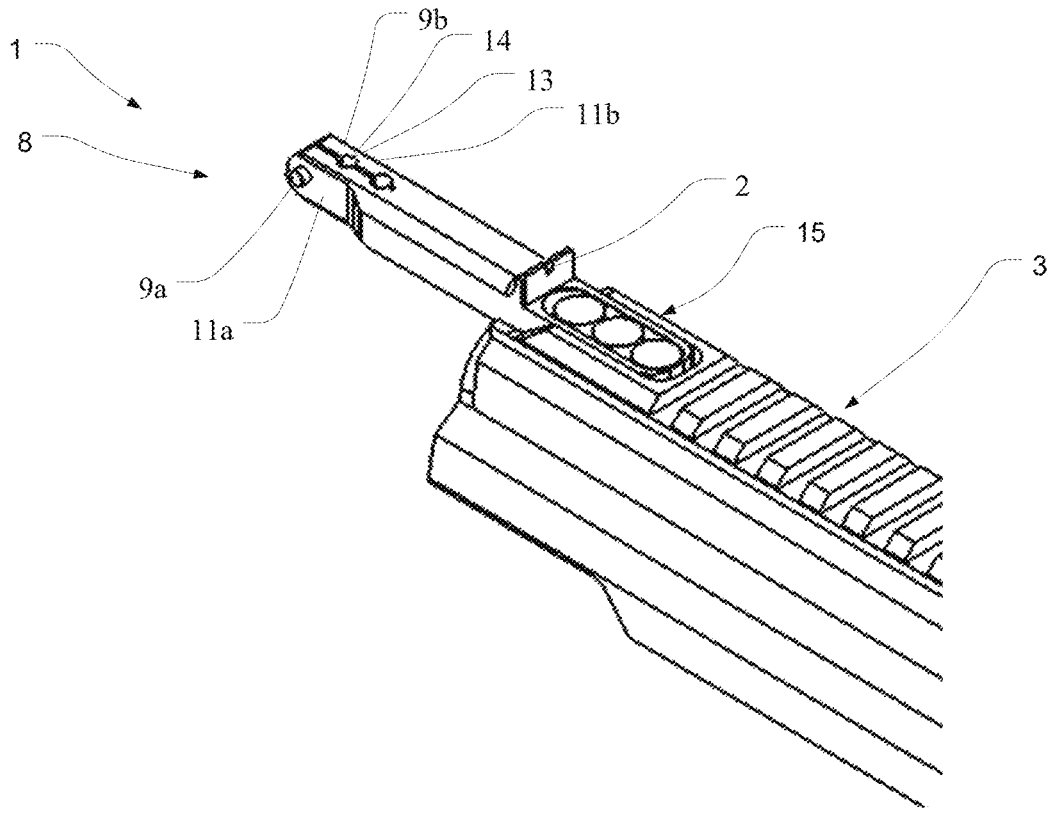
FIG. 10 is a perspective view of the forward portion of the accessory mounting attachment.

FIG. 10 shows a perspective view of the forward portion of the accessory mounting attachment 1 according to the invention. The rear sight leg 8 corresponds to the rear sight leg 8 in FIGS. 1 and 2. The rear sight leg 8 is horizontally adjustable relative to the mounting section 3 via a connector 15, which is illustrated as two or three fasteners. Two receiving arms 11*a* and 11*b* are formed and oppositely arranged at a front end section of the rear sight leg 8. The two receiving arms 11*a* and 11*b* are fork-shaped. The two receiving arms 11*a* and 11*b* are elastically adjustable. Pins 9*a* and 9*b* are arranged on each of the two receiving arms 11*a* and 11*b*. The two pins 9*a* and 9*b* extend in opposite horizontal directions, e.g., facing away from each other. A receiving bore 14 is formed between the two receiving arms 11*a* and 11*b*. The receiving bore 14 accommodates a lock 13. The lock 13 is configured as a screw that is screwed into the receiving bore 14. The more the screw is threaded into the receiving bore 14, the further away the two receiving arms 11*a* and 11*b* are horizontally deflected from each other. The rear sight leg 8 includes a rear sight 2, such as a notch sight. The rear sight 2 is arranged on the rear sight leg 8 at the height exceeding a top of the mounting rail 41 of the mounting section 3.

Figure 11:
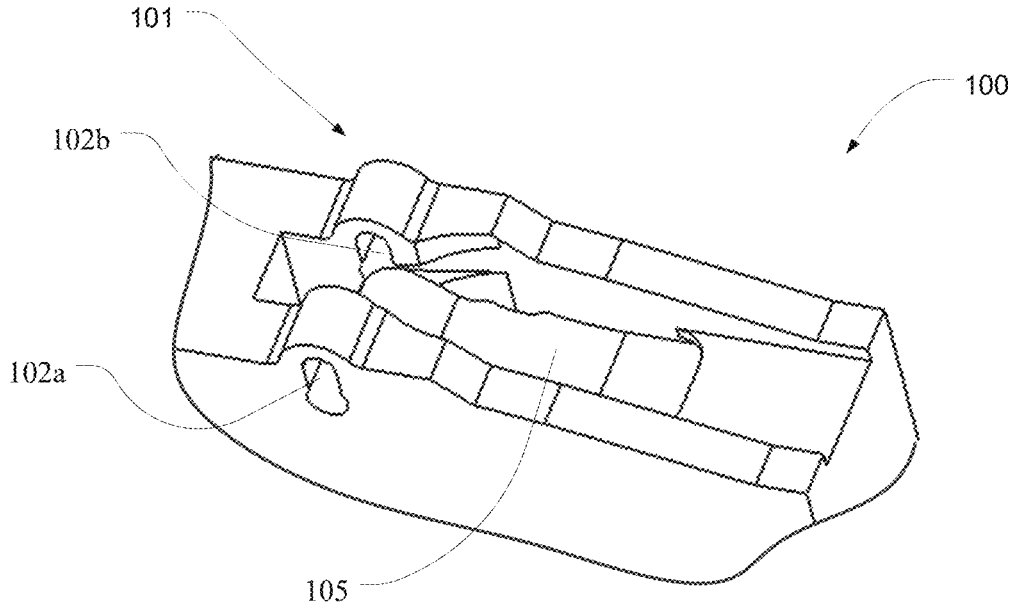
FIG. 11 is a perspective view of a rear sight base of the rifle.

FIG. 11 shows a perspective detailed view of a rear sight base 101 of a standard AK-style rifle 100. Two opposing recesses 102*a* and 102*b* are formed and arranged in the rear sight base 101. A resilient element 105 is arranged in a bottom section of the sight base 101.

Figure 12:
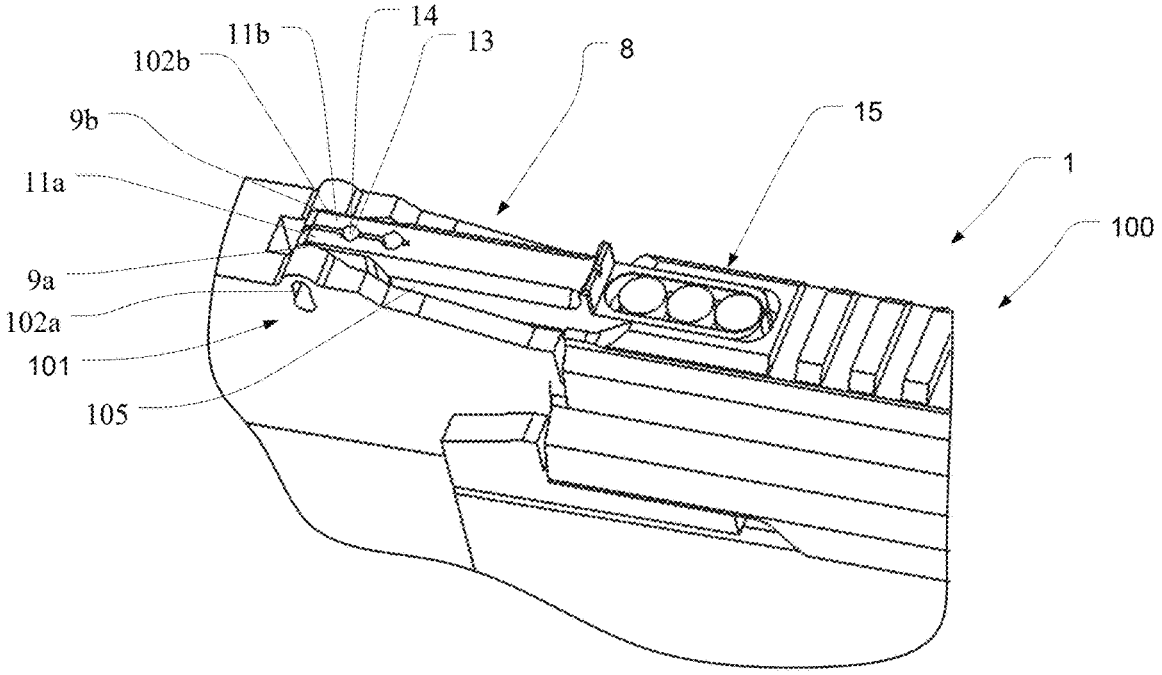
FIG. 12 is a perspective view of the front end section of a rear sight leg attached to the rear sight base of the rifle.

FIG. 12 shows a perspective detailed view of the front end section of the rear sight leg 8 attached to the rear sight base 101. The depiction in FIG. 12 results from a combination of the depictions in FIGS. 10 and 11. The accessory mounting attachment 1 is pivotably mounted in the rear sight base 101 of the rifle 100. The resilient element 105 is arranged between the rear sight leg 8 and the sight base 101 and bears on a lower surface of the rear sight leg 8. The resilient element 105 assists in the beginning upward pivoting action of the mounting section and, more importantly, holds the two pins 9*a* and 9*b* vertically upward into smaller and more defined alignment portions of the two opposing recesses 102*a* and 102*b* formed in the rear sight base 101, which keep a front of the accessory mounting attachment 1 in a consistent alignment position.

The pins 9*a* and 9*b* are configured such that they are repeatably and precisely inserted into the recesses 102*a* and 102*b* of the rear sight base 101. Using the lock 13 in the receiving bore 14, the two pins 9*a* and 9*b* are additionally positioned into the recesses 102*a* and 102*b* of the sight base 101 via the receiving arms 11*a* and 11*b* being spread apart when the lock 13, e.g., the screw, is threaded into the receiving bore 14.

Figure 13:
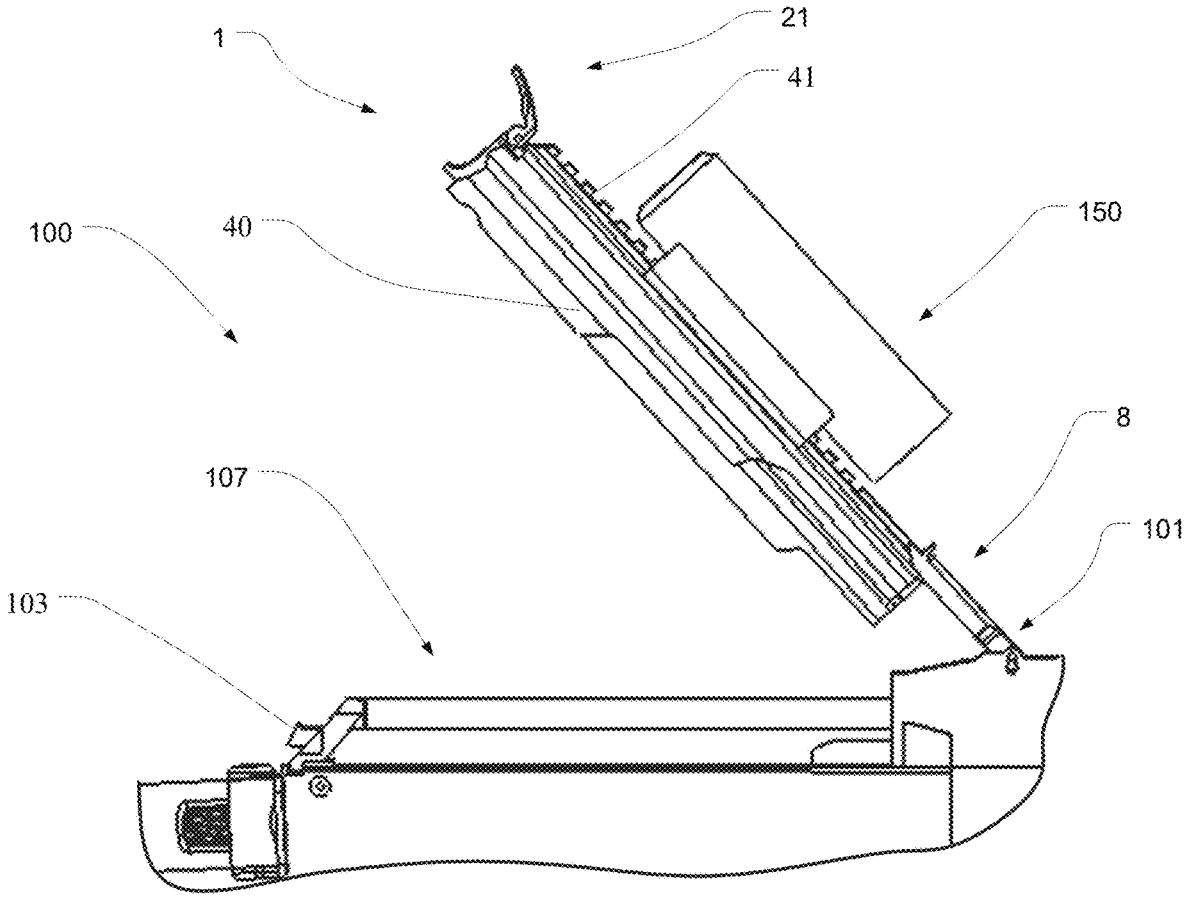
FIG. 13 a partial side view of the rifle with the accessory mounting attachment attached thereto in a pivoted open position.

FIG. 13 shows a partial, side view of the rifle 100 with the accessory mounting attachment 1 of FIGS. 2-12 according to the invention. The accessory mounting attachment 1 is pivoted upward to an open position via the pivot provided at the connection of the rear sight leg 8 and the sight base 101. The lock down assembly 21 is open with the lever section 25 raised, causing the lug latching frame 27 to be in the first position. The mounting section 3 has the dust cover 40 attached thereto or integrated therewith, as shown in FIG. 2. A sighting device 150, such as a scope, laser, or red-dot sight, is mounted to the top of the mounting rail 41. FIG. 13 also shows how the connecting lug 103 is connected to the recoil spring arrangement 107 of the rifle 100.

Figure 14:
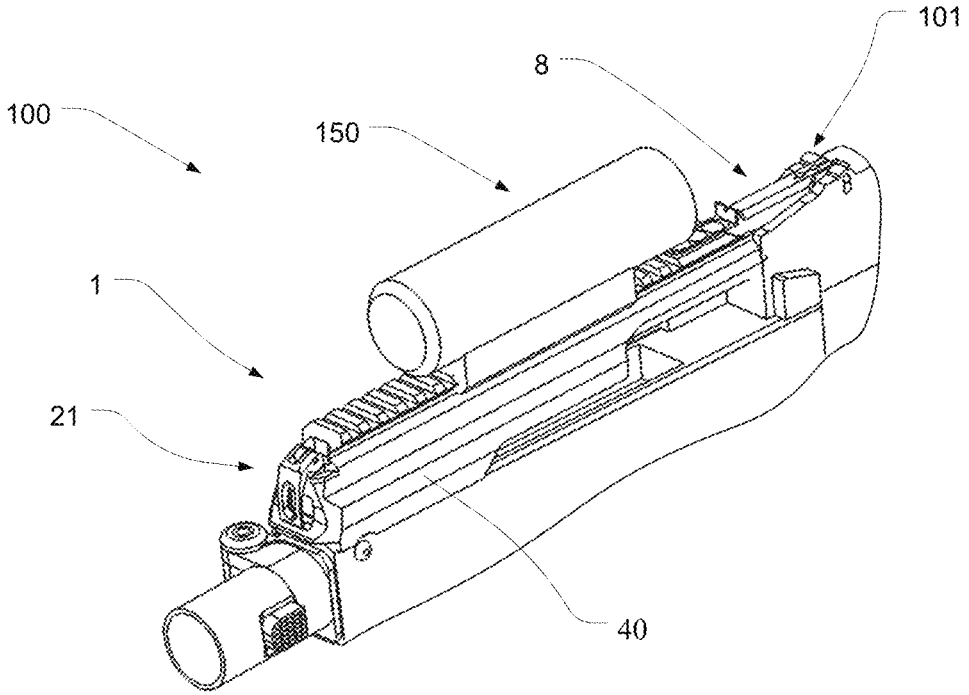
FIG. 14 a partial perspective view of the rifle with the accessory mounting attachment attached thereto in a closed position.

FIG. 14 shows a partial perspective view of the rifle 100 according to the invention. In contrast to FIG. 13, in FIG. 14 the accessory mounting attachment 1 is in the functional or closed position. The semi-shell shape of the dust cover 40 covers the top of the receiver and the recoil spring arrangement 107 therein. The lock down assembly 21 has the lever section 25 down in a closed or second position and in, or near, abutment with the rear of the mounting section 3. The lug latching frame 27 is in the second position. In the second position, the lug latching frame 27 is engaged in a latching manner with the connecting lug 103. Due to the latching of the lug latching frame 27 to the connecting lug 103, the accessory mounting attachment 1 is fixed relative to the barrel of the rifle 100 in a well-defined manner, and a repeatable manner. In other words, if the sighting device 150 is zeroed to the barrel of the rifle 100 at a given range, the lock down assembly 21 may be unlatched and the dust cover 40 may be opened to view the recoil spring arrangement 107 (FIG. 13). After inspecting, cleaning or servicing the recoil spring arrangement 107, the dust cover 40 may be closed and the lock down assembly 21 may be closed or latched (FIG. 14) and the zeroed arrangement of the sighting device 150 will be suitably restored, such that the sighting device 150 will need little or no adjustment to allow the operator to accurately fire the rifle 100 again.

In the embodiments of the invention, the accessory mounting attachment 1 may be made of aluminum or an aluminum alloy. The accessory mounting attachment 1 may be made of steel or a steel alloy. Individual components of the accessory mounting attachment 1 may be made of aluminum and steel. The mounting section 3 may be made of an aluminum alloy. The aluminum may be rolled. The aluminum may be forged. The aluminum alloy may be an aluminum alloy 7075. The components of the accessory mounting attachment 1 may be anodized. The anodization may be a hard anodized coating. The components made of steel may be hardened. The components made of steel may be coated. The components may be manufactured by turning and milling. The components may be manufactured using metal injection molding (MIM process).

The sight base 101 is typically formed on a housing part of the rifle 100. Before installation of the accessory mounting attachment 1, any components attached to the sight base 101 should be removed. The resilient element 105, e.g., leaf spring, would remain in the sight base 101 during installation. By mounting the accessory mounting attachment 1 in the sight base, a longitudinal axis of the accessory mounting attachment 1 is aligned parallel to a bore axis of the barrel of the rifle 100.

Due to the pivotable mounting, the accessory mounting attachment 1 may be quickly pivoted away from the receiver of the rifle 100 after a jam or obstruction. Subsequently, the accessory mounting attachment 1 may be pivoted back onto the receiver of the rifle 100 in a repeatable manner. This allows jams or obstructions to be quickly resolved.

The connecting lug 103 may be part of the recoil spring arrangement 107. The recoil spring arrangement 107 may be a return mechanism. The recoil spring arrangement 107 returns a bolt to its starting position, allowing the rifle 100 to automatically reload and remain operational. The connecting lug 103 may be connected to an adjustable guide rod of the recoil spring arrangement 107.

In the description, "vertical" is considered perpendicular to "horizontal." The longitudinal axis or extension direction of the accessory mounting attachment 1, as well as the bore axis of the barrel of the rifle 100, are considered horizontal, and a top surface of the mounting rail 41 is considered to reside in a horizontal plane.

The vertical position of the lug latching frame 27 relative to the eccentric element 23 is finely adjusted before or during installation of the accessory mounting attachment 1. This pre-adjustment performed before or during installation allows subsequent actuating movements of the eccentric element 23 to have desired displacements of the lug latching frame 27. During the actuating movements of the lever section 25 between open and closed positions, the lug latching frame 27 may be moved vertically in a repeatable manner between the desired first position and second position. The pre-adjustment of the vertical position of the lug latching frame 27 creates a repeatable pattern to keep the sighting device 150 zeroed to the barrel of the rifle 100. This ensures that accuracy is maintained.

A release mechanism may be applied on the rear end section of mounting section 3. The release mechanism can be configured in such a way that the connecting lug 103 is displaced along the bore axis in the barrel direction of the rifle, when the release mechanism is used. The release mechanism can be used to depress the connecting lug 103 by a hand movement of the operator, and may take the form of a bullet tip at the end of a live round, a prong of rifle strap buckle or any other rigid, flat or cylindrical object that can pass through the aligned latching window 29 and the lug access opening 5. This releases the engagement between the lug latching frame 27 and the connecting lug 103.

In the case where the accessory mounting attachment 1 is to be pivoted away, the lug latching frame 27 is first moved into the first position via the actuating movement of the eccentric element 23 via the lever section 25. The lug latching frame 27 is then in the open position, unlatching the connecting lug 103. Subsequently, the connecting lug 103 is pressed in the direction of the recoil spring 107 through the aligned latching window 29 and the lug access opening 5. This may be done by the use of the release mechanism. The connecting lug 103 is pushed out of the latching window 29. The accessory mounting attachment 1 remains pivotably positioned on the rifle 100 via the rear sight leg 8. This allows the accessory mounting attachment 1 to be moved into a pivoted-away position, ensuring that the recoil spring arrangement 107 remains quickly accessible for cleaning or repair.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. An accessory mounting attachment for repeatable precise alignment on a rifle, the accessory mounting attachment comprising:

a mounting section;

a rear sight leg at a front end section of the mounting section, configured for mounting to a sight base on the rifle; and a lock down assembly at a rear end section of the mounting section, configured to fix the mounting section to a movable connecting lug at a rear of a receiver of the rifle, the lock down assembly including:

an eccentric element;

a lug latching frame; and a coupling element connecting the eccentric element to the lug latching frame, wherein the lug latching frame is vertically displaceable via the coupling element in response to actuating movements of the eccentric element, and wherein the lock down assembly is configured to lock to the rifle after an actuating movement of the eccentric element placing the lug latching frame in a second position, where the lug latching frame engages in a latching manner with the connecting lug, thereby allowing the accessory mounting attachment to be fixed in a defined position relative to a barrel on the rifle, and wherein the lock down assembly is configured to release from the rifle after an actuating movement of the eccentric element places the lug latching frame in a first position, disengaged from latching to the connecting lug.

2. The accessory mounting attachment according to claim 1, wherein an actuating movement of the eccentric element entails rolling the eccentric element within rolling tracks formed on the mounting section, and wherein an axle couples the eccentric element to the coupling element and an axle opening within the eccentric element is off-center.

3. The accessory mounting attachment according to claim 2, wherein a cam disk is formed as an outer surface of the eccentric element, said cam disk rolls within the rolling tracks formed on the mounting section, and the axle opening is off-center relative to the cam disk.

4. The accessory mounting attachment according to claim 1, wherein a latching window is formed on the lug latching frame and a lug access opening is formed on a rear of the mounting section, each configured and aligned to allow access to the connecting lug.

5. The accessory mounting attachment according to claim 1, wherein the eccentric element is arranged on an outer side of the mounting section, the lug latching frame is arranged on an inner side of the mounting section, and the coupling element is arranged in a coupling element opening passing through the mounting section.

6. The accessory mounting attachment according to claim 5, wherein the lug latching frame slides vertically between opposing guide recesses formed on the inner side of the mounting section.

7. The accessory mounting attachment according to claim 1, wherein the lug latching frame and the coupling element are connected via an adjuster for adjusting a distance between the eccentric element and the lug latching frame.

8. The accessory mounting attachment according to claim 7, wherein the adjuster includes first threads formed in or on a portion of the coupling element engaged with second threaded forming on or in a hole within the lug latching frame.

9. The accessory mounting attachment according to claim 1, wherein the lock down assembly includes an elastic acting in a vertical direction, which is arranged between the eccentric element and the lug latching frame on an inner side of the mounting section.

10. The accessory mounting attachment according to claim 1, wherein the eccentric element includes a lever section, which extends away from an outer side of the mounting section to assist in the actuating movements of the eccentric element.

11. The accessory mounting attachment according to claim 1, wherein the mounting between the rear sight leg and the sight base on the rifle is a pivotable mounting, and wherein the rear sight leg includes two opposing pins for the pivotable mounting to the sight base.

12. The accessory mounting attachment according to claim 11, wherein a front end section of the rear sight leg is formed as first and second receiving arms which are spaced apart and elastically adjustable, with one of the two opposing pins mounted to the first receiving arm and a second of the two opposing pins mounted to the second receiving arm.

13. The accessory mounting attachment according to claim 12, wherein the rear sight leg includes a lock for locking the two pins to the sight base, and wherein and the lock is disposed between the first and second receiving arms and spreads the first and second receiving arms apart to seat the two pins into two recesses of the sight base.

14. The accessory mounting attachment according to claim 1, wherein the rear sight leg is attached to the mounting section by fasteners and is horizontally adjustable relative to the mounting section.

15. The accessory mounting attachment according to claim 1, wherein the mounting section includes a top mounting rail for receiving an accessory component, wherein the top mounting rail is arranged on an outer side of the mounting section.

16. The accessory mounting attachment according to claim 1, wherein the mounting section is configured as a dust cover for the rifle.

17. A rifle comprising the accessory mounting attachment according to claim 1.

18. The rifle according to claim 17, wherein the mounting section is configured as a dust cover.

19. The rifle according to claim 18, wherein the accessory mounting attachment is pivotably mounted to the sight base of the rifle via the rear sight leg and fixed to the connecting lug of the rifle via the lock down assembly.

20. The rifle according to claim 19, wherein a resilient element is arranged between the rear sight leg and the sight base, and wherein the connecting lug is connected to a recoil spring arrangement within the rifle.

* * * * *